US006374067B1

(12) United States Patent
Park

(10) Patent No.: US 6,374,067 B1
(45) Date of Patent: Apr. 16, 2002

(54) DOOR APPARATUS OF AN ELECTROPHOTOGRAPHIC IMAGE PRINTER

(75) Inventor: Geun-yong Park, Suwon (KR)

(73) Assignee: Samsung Electronics Co., Ltd., Suwon (KR)

( * ) Notice: Subject to any disclaimer, the term of this patent is extended or adjusted under 35 U.S.C. 154(b) by 28 days.

(21) Appl. No.: 09/691,839

(22) Filed: Oct. 18, 2000

(30) Foreign Application Priority Data

Nov. 29, 1999 (KR) ..... 99-53559

(51) Int. Cl.[7] ..... G03G 15/00
(52) U.S. Cl. ..... 399/107; 399/110
(58) Field of Search ..... 399/107, 110, 399/111, 115–117, 119, 121, 122, 237; 312/321.5, 293.1, 293.2, 293.3, 223.1; 464/176, 177, 178; 347/108, 152, 263

(56) References Cited

U.S. PATENT DOCUMENTS 4,831,393 A * 5/1989 Dean et al. ..... 347/152
5,570,159 A * 10/1996 Hirose et al. ..... 399/107
5,918,089 A * 6/1999 Malinich et al. ..... 361/809
6,061,537 A * 5/2000 Nakajima et al. ..... 399/107
6,118,073 A * 9/2000 Lau et al. ..... 174/66
6,274,846 B1 * 8/2001 Ono et al. ..... 198/808

FOREIGN PATENT DOCUMENTS

JP 11-245483 A * 9/1999 ..... B41J/29/13

* cited by examiner

*Primary Examiner*—Robert Beatty
(74) *Attorney, Agent, or Firm*—Robert E. Bushnell, Esq.

(57) ABSTRACT

A door apparatus used in an electrophotographic image printer includes a door frame mounted on a surface of a main body of the printer and rotatably opened and closed, a pressure-unit fixing bracket attached to an inner side of the door frame, and a buffer unit movably supporting the pressure-unit fixing bracket against the door frame and spaced-apart from the door frame by a certain distance. A plurality of holes are formed on the pressure-unit fixing bracket and receives shafts of components installed in the main body and the shafts are disposed adjacent to the door frame when the door frame is closed. The pressure-unit fixing bracket moves against the door while the shafts are inserted into the holes.

20 Claims, 8 Drawing Sheets

DOOR APPARATUS OF AN ELECTROPHOTOGRAPHIC IMAGE PRINTER

CLAIM OF PRIORITY

This application makes reference to, incorporates the same herein, and claims all benefits accruing under 35 U.S.C. §119 from an application for FRONT DOOR OF A LIQUID ELECTROPHOTOGRAPHIC PRINTER earlier filed in the Korean Industrial Property Office on Nov. 29, 1999 and there duly assigned Serial No. 53559/1999.

BACKGROUND OF THE INVENTION

1. Field of the Invention

The present invention relates to a wet type electrophotographic image printer, and more particularly, to the wet type electrophotographic image printer having a front door rotatably mounted on a printer body of the apparatus to be opened and closed for repair and replacement of various kinds of components contained in the printer body.

2. Description of the Related Art

A printing machine such as a laser printer, a duplicating apparatus, etc. includes various kinds of components installed in a main body of the printing machine. Sidewalls enclose the main body is while a bracket is attached to the components for a printing operation. Once the bracket is fit into the components, and connectors such as bolts or pins couple the bracket to the components, the sidewalls cover the main body. The components worn out by the repeated printing operations are periodically replaced, and some broken components should be immediately repaired. When the repair or the replacement of the components is needed, one of the side walls is detached from the main body, and the bracket is removed from the components. After the repair or the replacement of the components, the bracket is attached to the components, and then the sidewall is fixed to the main body.

The sidewalls, however, may not be properly attached to the main body unless the bracket is precisely located on the components. Moreover, if one of the connectors connecting the bracket to the components and the sidewalls to the main body is lost, the bracket and the sidewall can not be accurately attached to the components and the main body, respectively. During the repair and the replacement of the components, the bracket, sidewalls, and connectors should be kept in an area adjacent to the printing machine and used for coupling the bracket and the side walls to the components and main body after the printing machine is fixed. Even if a small door is attached to one of the sidewalls, the sidewall should be detached from the main body in order to remove the bracket from the components before the components is replaced or repaired since the bracket is disposed between the components and the sidewalls. This features of the printing machine is very complicated to couple the bracket and the sidewall to the components and the main body, respectively, and it takes too much time to repair and replace the components.

SUMMARY OF THE INVENTION

It is an object of the present invention to provide a printing machine able to both support components installed in a main body of the printing machine and covering the main body.

It is another object to provide a printing machine able to quickly repair and replace components contained in a main body of the printing machine by easily attaching and detaching a bracket and a sidewall from the components and the main body, respectively.

It is yet another object to provide a printing machine able to precisely couple a bracket to components installed in a main body of the printing machine and couple a sidewall to the main body after repair and replacement of the components.

It is still another object to provide a printing machine able to easily open a door mounted on a sidewall of a main body of the printing machine and a bracket mounted on the door.

It is a further object to provide a printing machine able to precisely close a door against a sidewall of a main body of the printing machine while a bracket attached inside the door supports components installed in the main body.

It is also an object to provide a printing machine able to reduce the time required to repair and replace components installed in a main body of the printing machine.

These and other objects may be achieved by providing a wet type electrophotographic image printing machine including a door apparatus mounted on one of sidewalls of a main body of the printing machine, a door frame of the door apparatus rotatably mounted a front side of the sidewalls, a hinge unit disposed between the door frame and the sidewall, and a pressure-unit fixing bracket mounted on an inner surface of the door frame, rotating along with the door frame, supporting various types of components and pressure units such as a backup roll shaft of a photosensitive belt, a shaft of a developing roll, a shaft of a squeezing roll, etc., and preventing interference between the components and the pressure units. The printing machine includes a buffer unit disposed between the inside of the door frame and the pressure-unit fixing bracket to movably mount the pressure- unit fixing bracket on the door frame.

The buffer unit includes at least four guiding holes formed in the door frame, guide protrusions formed on the pressure-unit fixing bracket to correspond to the four guiding holes, anti-bolt pins inserted through each of the guiding holes and engaged with the ends of the guiding protrusions, and compressing coil springs engaged with each of the guiding protrusions for elastically supporting the pressure-unit fixing bracket toward the door frame in a manner that the pressure-unit fixing bracket is spaced from the door frame at a certain distance.

A door-side hinge bracket is attached to the upper side of the door frame. The door-side hinge bracket has hinge protrusions to be inserted into the hinge holes of a pair of body-side hinge brackets adhered to the body of the printing machine. A locking/unlocking unit is installed at the other side of the door frame and locks and unlocks the door frame to and from the main body of the printing machine. The lock/unlocking unit includes hooks formed at the upper and lower ends to be fixed by a hooking locker attached to the body of the printing machine, a locking bar rotatably installed at a pair of fixing pieces attached to the door frame, a spring for elastically supporting the locking bar for rotational movement thereof to hook the hook with the locker, and a handle formed at a center portion of the locking bar.

Position-determining holes are formed on both sides of the pressure-unit fixing bracket. The pair of guide pins installed at the main body of the printing machine are inserted into the position determining holes while the door is closed, and then the pressure-unit fixing bracket can be fit to the exact position of the main body of the printing machine.

BRIEF DESCRIPTION OF THE DRAWINGS

A more complete appreciation of the invention, and many of the attendant advantages, thereof, will be readily apparent as the same becomes better understood by reference to the following detailed description when considered in conjunction with the accompanying drawings in which like reference symbols indicate the same or similar components, wherein.

DESCRIPTION OF THE INVENTION

Figure 1:
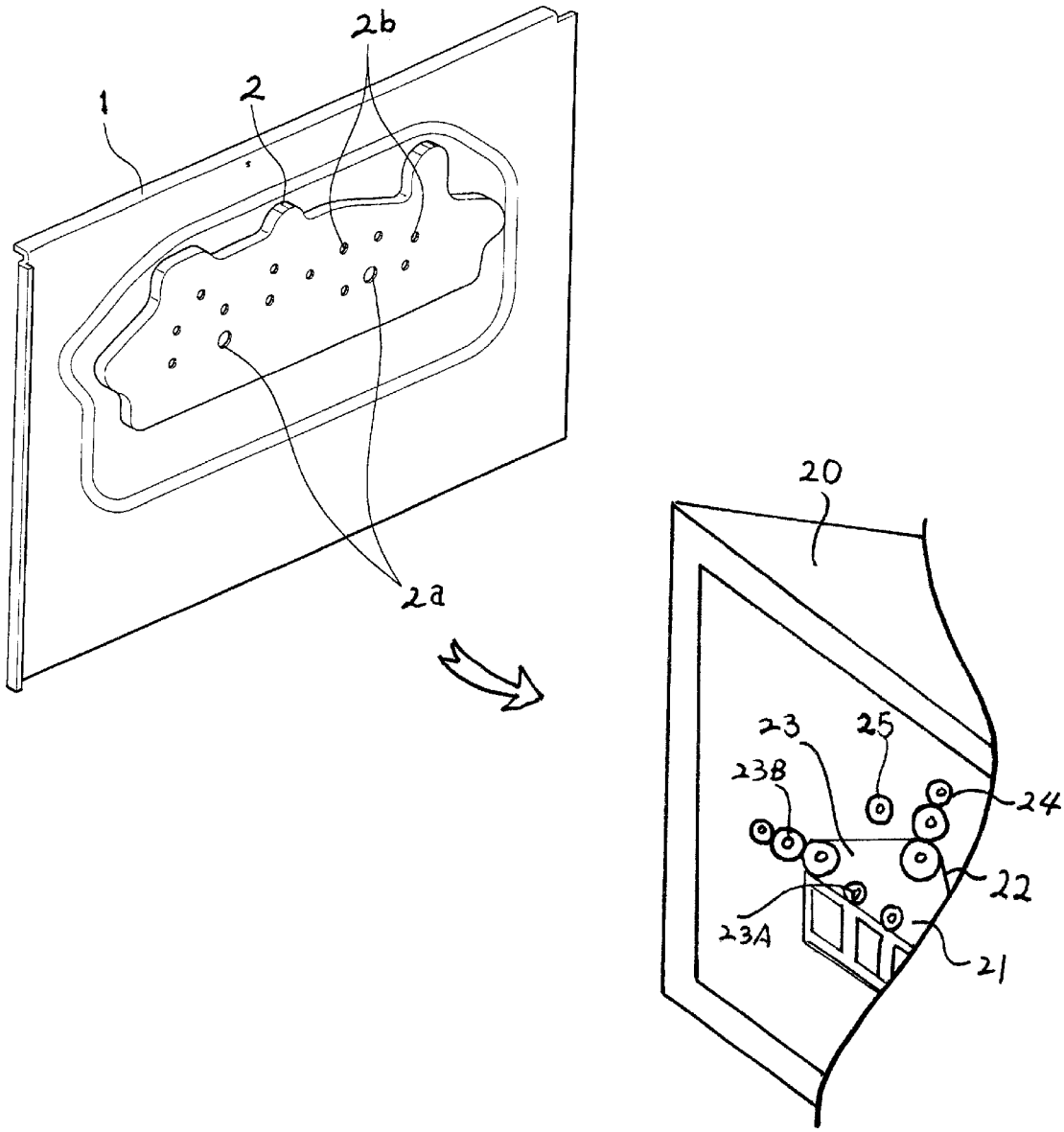
FIG. 1 is a perspective view showing a door to be assembled into a main body of a wet type electrophotographic image printing apparatus according to the principle of the present invention.

Referring now to drawings, in the wet type electrophotographic image printing machine as shown in FIG. 1, a front door includes a door frame 1 and a pressure-unit fixing bracket 2 integrally attached to an inside of door frame 1. Pressure-unit fixing bracket 2 secures a pressure unit closely supporting a developing roll and a squeezing roll of a developing unit 21 to a sensitive belt of a sensitive belt 22 unit and maintaining the developing roll and the squeezing roll of the developing unit 21 to rotate the sensitive belt of the sensitive belt unit 22 around the developing unit 21 at regular intervals. The wet type electrophotographic image printing machine includes two pressure units placed on both sides of the developing unit and the sensitive belt unit. Each pressure unit is disposed on each side of the developing unit 21 and the sensitive belt unit 22 to support the developing unit 21 rotating the sensitive belt unit 22. One of the two pressure units is disposed on a sidewall of the main body where the door is mounted on the main body. When repair and replacement of any one of the developing unit 21, the sensitive belt unit 22, and any other components 24 installed in the main body, the repair and the replacement can be done after the door is opened, and the pressure unit is detached from the developing unit 21 and the sensitive belt unit 22. Pressure-unit fixing bracket 2 is supposed to accommodate the insertion of parts 23 of the developing unit 21, the sensitive belt unit 22, and the components 24 installed in the main body and support the pressure unit attached to the developing unit 21, the sensitive belt unit 22 when the door is closed. Accordingly, pressure-unit fixing bracket 2 is disposed between door frame I and the pressure unit to be attached to door frame 1 since pressure-unit fixing bracket 2 supports the pressure unit while door frame is closed to the sidewall of the main body.

A plurality of fixing holes 2*a* stationing the pressure unit are formed on pressure-unit fixing bracket 2, and a number of shaft-supporting holes 2*b* each accommodating the insertion of each end of mechanical members of the pressure unit 25 installed in the main body of the printing machine. A lifting member having a shaft 23A of the developing roll of the developing unit 21 and a shaft 23B of the squeezing roll is included in the mechanical members. Therefore, when the front door is open and closed, the shafts 23A, 23B are fit into fixing holes 2*a* and shaft supporting holes 2*b* without having any interference between the shafts 23A, 23B and the fixing holes 2*a* and shaft supporting holes 2*b*.

Figure 2:
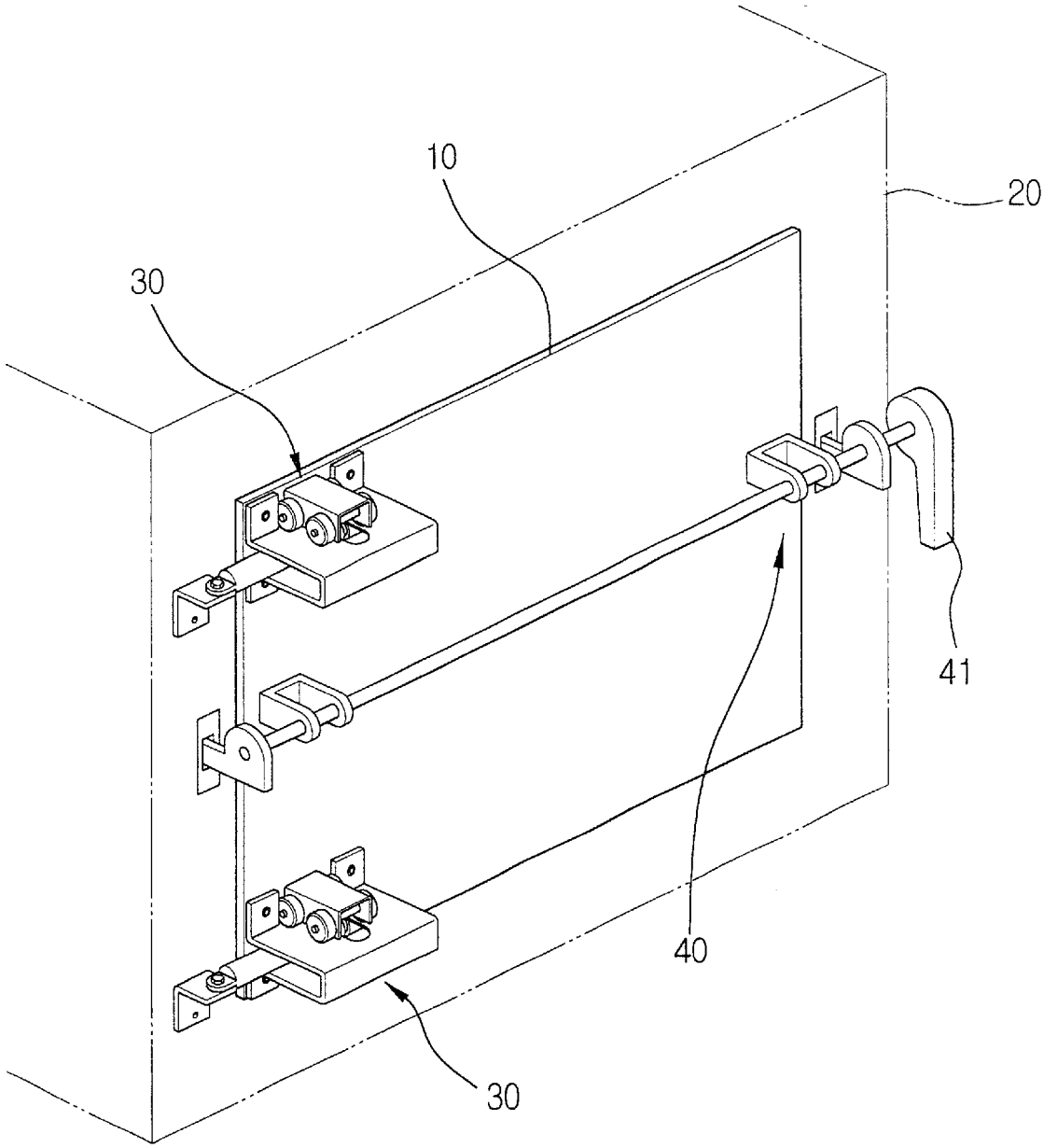
FIG. 2 is a perspective view showing an assembled state of the printing apparatus and the door shown in FIG. 1.

FIG. 2 shows a door frame 10 mounted on a sidewall of a main body 20 in the printing machine by a pair of hinge units 30. The pair of hinge units 30 are disposed to allow door frame 10 to rotate about a predetermined center of the hinge units attached to main body 20 of the printing machine and also move toward or from main body 20 in a direction perpendicular to the sidewall of main body 20 or parallel to the shafts of pressure unit in the printing machine. In FIG. 2, a reference number 40 denotes a locking and unlocking unit locking and unlocking front door 10 at and from main body 20 of the printing machine. A handle 41 is attached to locking and unlocking unit 40.

Figure 3:
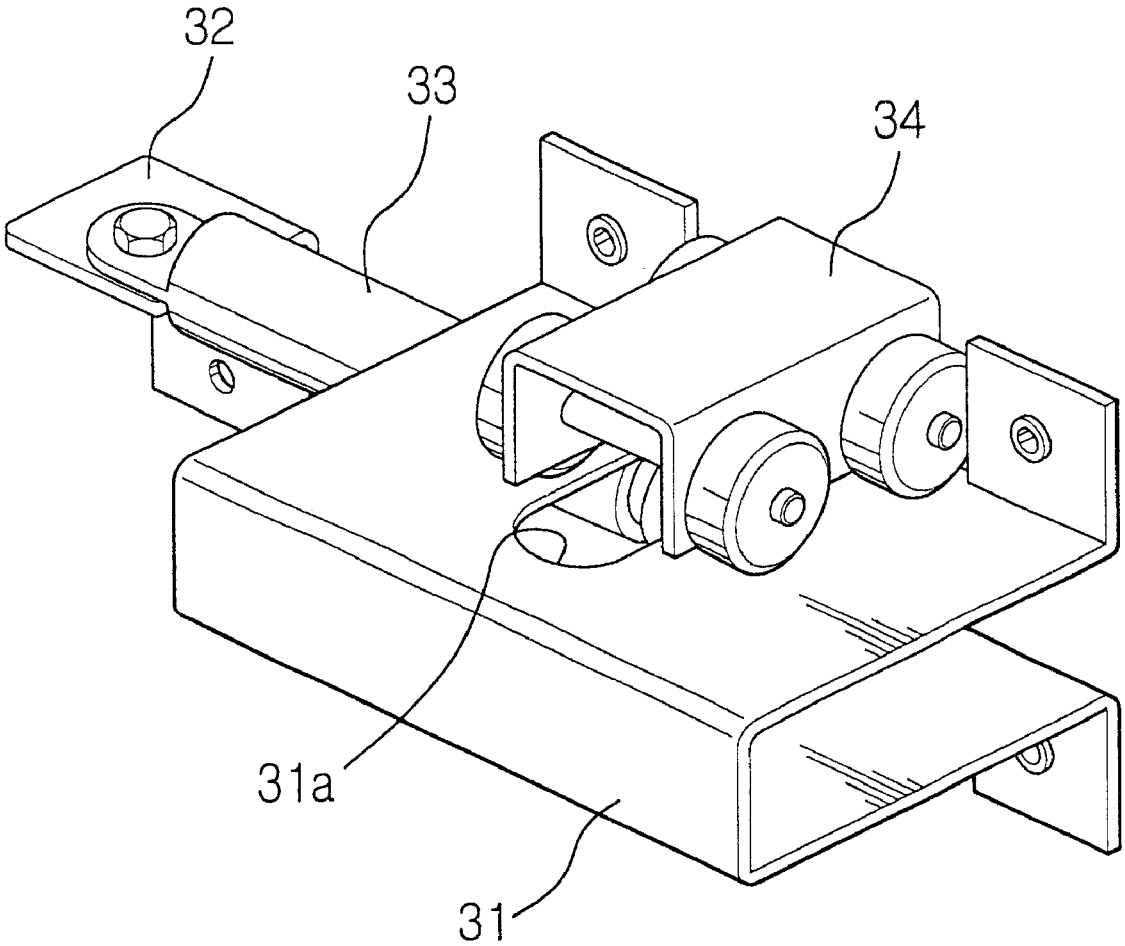
FIG. 3 is a perspective view of a hinge unit of the door mounted on the printing apparatus.
Figure 4:
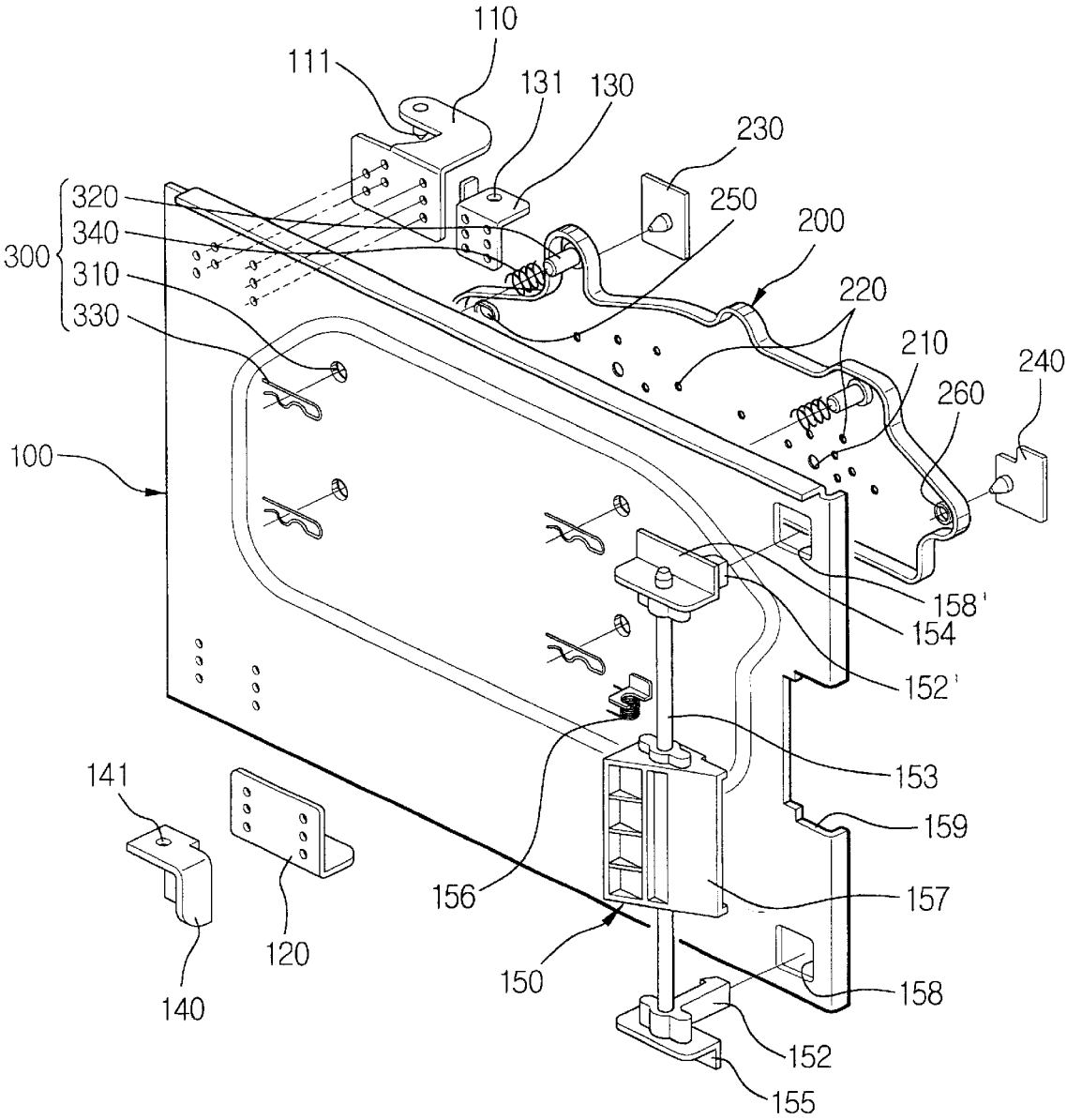
FIG. 4 is an exploded perspective view of another embodiment of the door according to the principle of the present invention.

As shown in FIG. 3, hinge units 30 are fixed to door frame 10. Each hinge unit 30 includes a door-side hinge bracket 31 fixed to door frame 10 and having a sliding hole 31*a* formed at a center of door-side hinge bracket 31, a body-side hinge bracket 32 fixed to main body 20 of the printing machine, a hinge-lever assembler 33 connecting body-side hinge bracket 32 to door-side hinge bracket 31, and a sliding element 34 installed to be slid along sliding hole 31*a* of door-side hinge bracket 31, slidably connected to one end of hinge lever assembler 33, and disposed to rotatably move from main body 20 with hinge lever assembler 33 after moving along sliding hole 31*a* in the direction parallel to the shafts when the door is open and move along sliding hole 31*a* parallel to the shafts after rotatably moving with hinge lever assembler 33 toward main body 20.

In a closed state as shown in FIG. 2, when a handle 41 of locking and unlocking unit 40 is pulled from the main body 20, door frame 10 is released from main body 20 of the printing machine by the pair of hinge units 30. Thus, door frame 10 covering the sidewall of main body 20 of the printing machine is opened. A spring is disposed between sliding element 34 and hinge lever assembler 33 to bias sliding element 34 pushing against the sidewall of main body 20 in the closed state. When door frame 10 is opened, sliding element 34 slides along sliding hole 31*a* by the tension of the spring and move from the sidewall of main body 20 in the direction parallel to the shafts or perpendicular to the sidewall of main body 20. Therefore, the front door 10 is separated from the body 20 of the printing machine, and then door frame 10 is completely opened by rotating around a hinge point of hinge lever assembler 33. When front frame 10 is opened by the operation of hinge units 30, door frame 10 is easily released from main body 20 of the printing machine without causing any interference between the pressure unit fixing bracket and the shafts of various kinds of components installed in main body of the printing machine.

When door frame 10 is closed, a closing operation of door frame 10 is performed in a reverse manner when door frame 10 is opened. After door frame 10 rotates about the hinge point, door frame 10 is rotated toward main body 20 of the printing machine, closely attached to main body 20 of the printing machine, and then move toward main body 20 by sliding the sliding element 34 along sliding hole 31*a* at a certain time before the door frame 10 is completely closed. Thus, pressure-unit fixing bracket 2 attached to door frame 10 fits the corresponding end of shafts of the components and thus support the shaft of each component in main body 20 of the printing machine.

Referring now to FIGS. 4 through 8, a front door includes a door frame 100, a pressure-unit fixing bracket 200 mounted on an inner surface face of door frame 100, and a buffer unit 300 elastically supporting pressure-unit fixing bracket 200 against door frame 100.

A pair of door-side hinge brackets 110 and 120 are attached to upper and lower portions of one side of door frame 100. Each of hinge protrusions 111 and 121 is protruded from each of hinge brackets 110 and 120 and inserted into each of hinge holes 131 and 141 formed on a pair of body-side hinge brackets 130 and 140 fixed to the main body of the printing machine so that door frame 100 mounted on the main body of the printing machine can be rotatably opened and closed.

Figure 5:
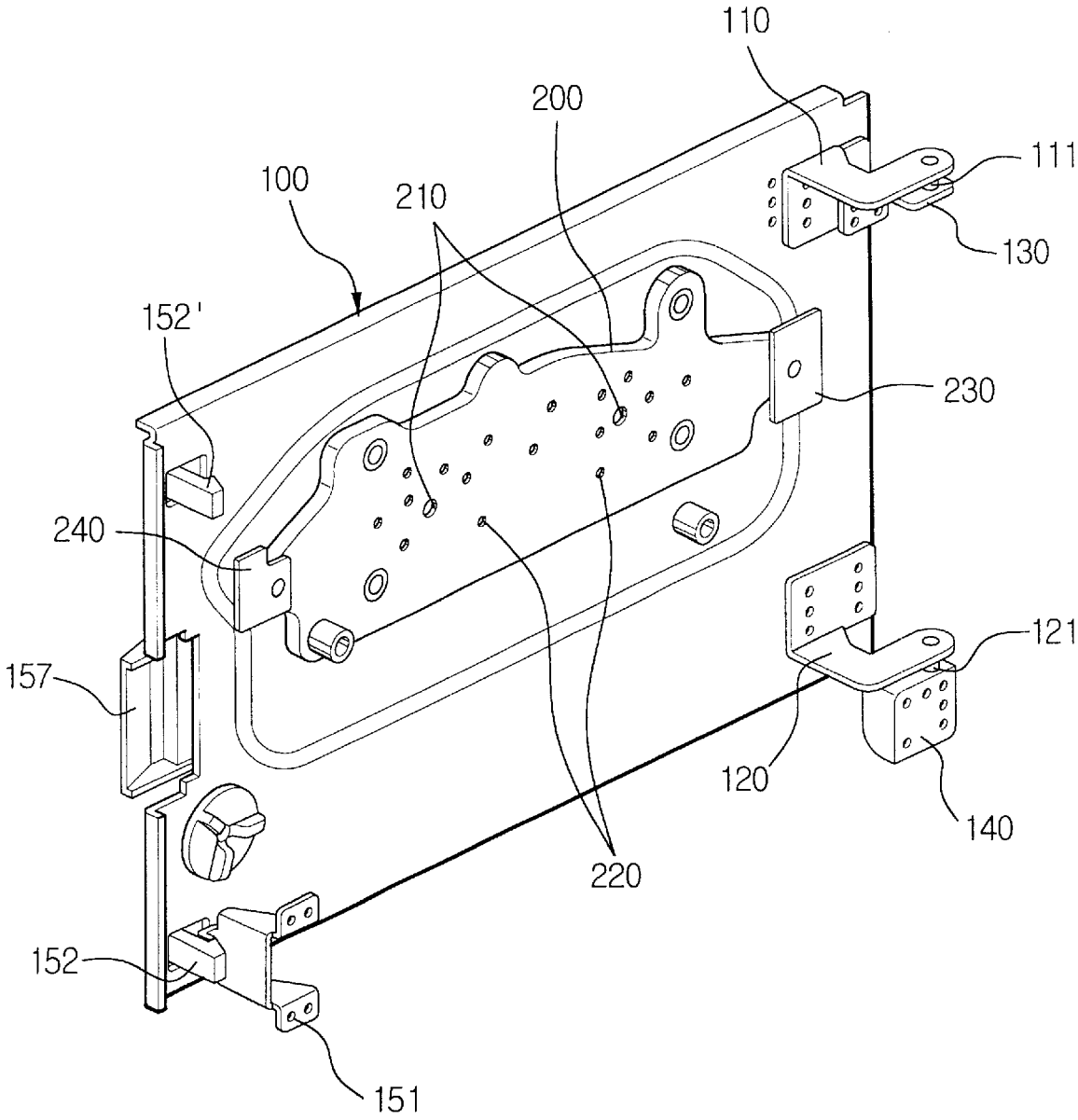
FIG. 5 is a perspective view of an inside of the door of FIG. 4.
Figure 6:
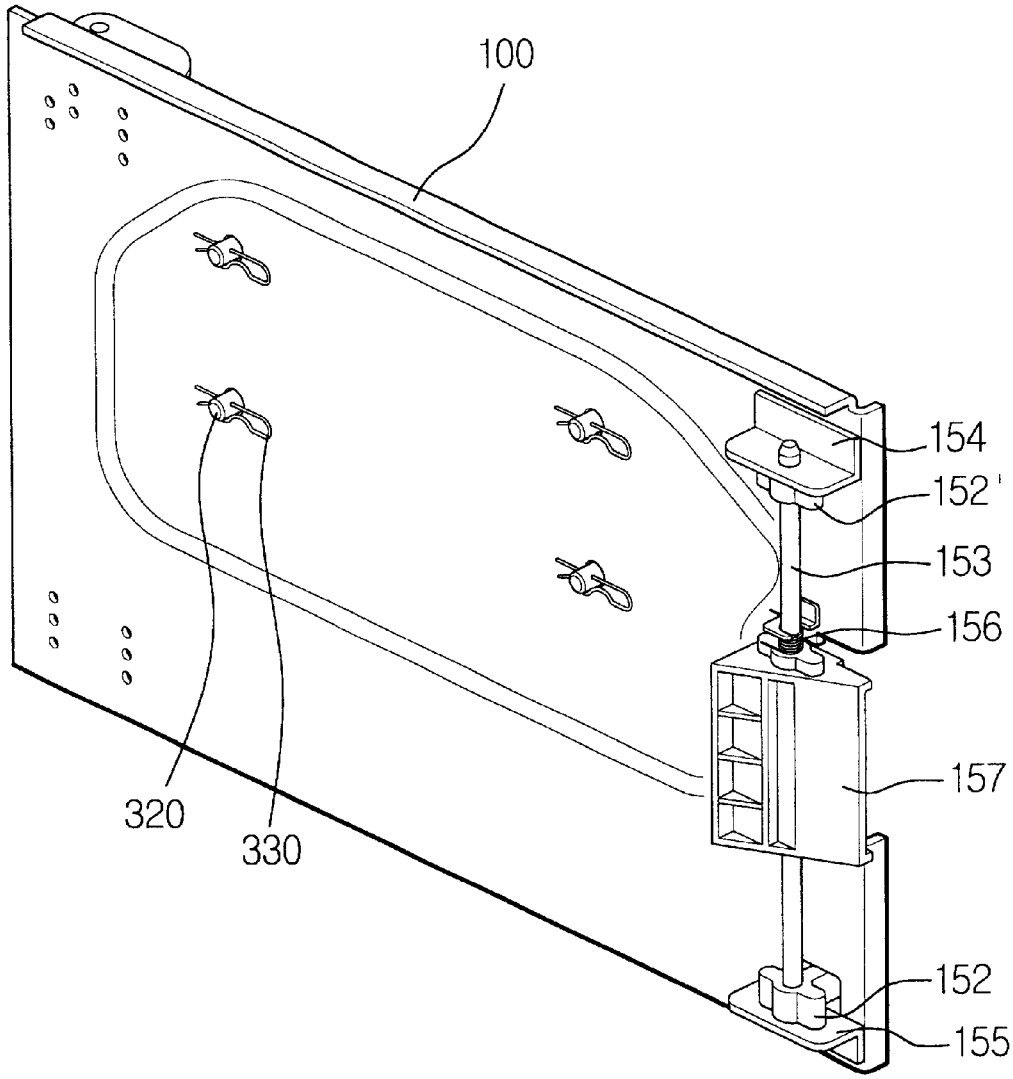
FIG. 6 is a perspective view of an outside of the door of FIG. 4.
Figure 7:
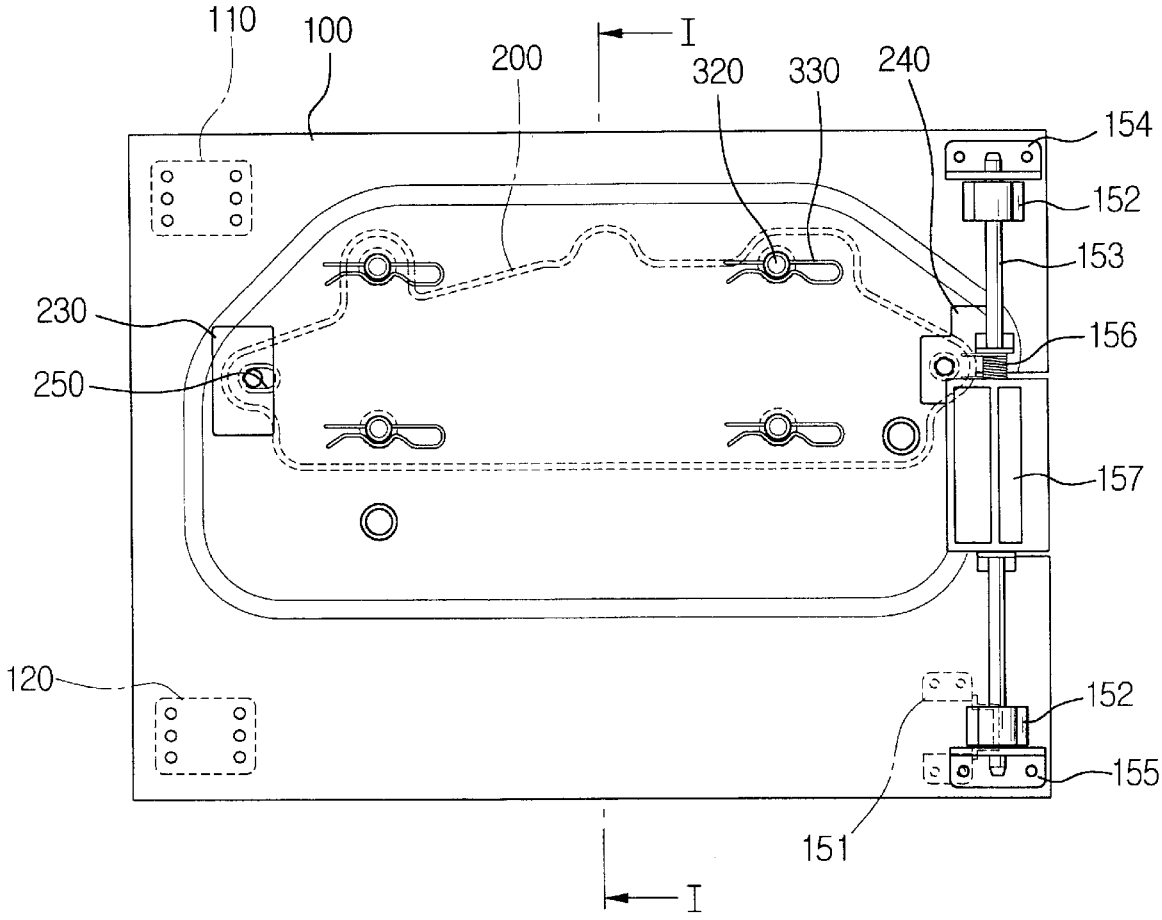
FIG. 7 is a front view showing the assembled state of the door mounted on a main body of the printing apparatus.
Figure 8:
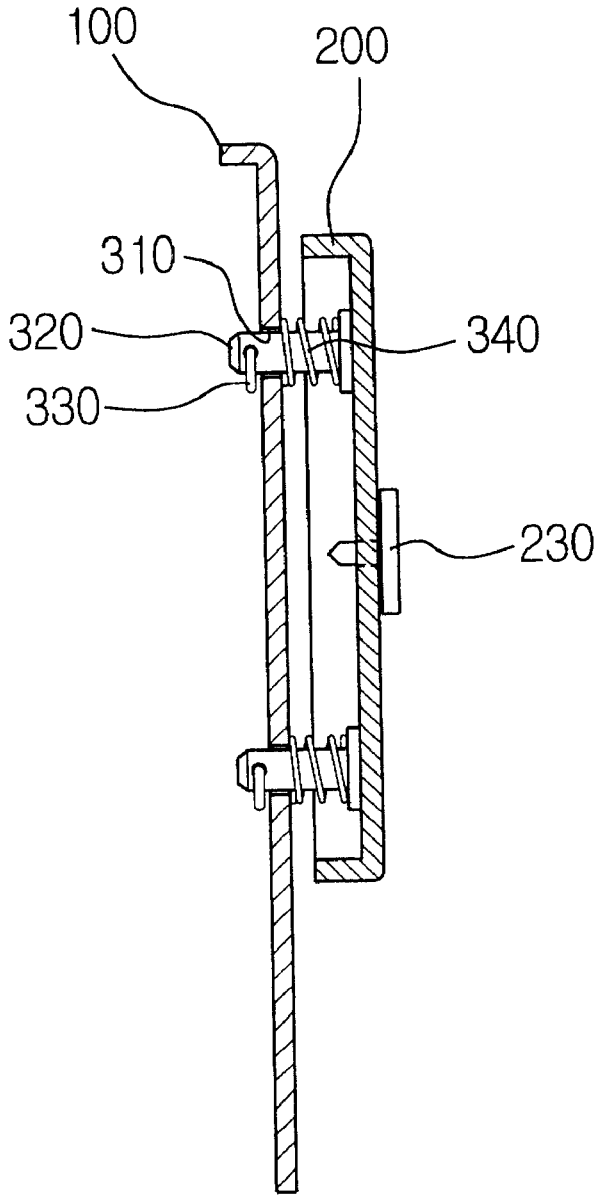
FIG. 8 is a partial cross-sectional view taken along lines I—I of FIG. 7.

A locking and unlocking unit 150 is installed at the other side of door frame 100 for locking and unlocking door frame 100 to and from the main body of the printing machine. Locking and unlocking unit 150 includes a locking bar 153 having hooks 152 and 152' formed on upper and lower ends of locking bar 153 and hooked by a locker 151 mounted on the main body as shown in FIG. 5, a pair of fixing pieces 154 and 155 attached to the upper and lower sides of door frame 100 for movably supporting the locking bar 153 rotating about a center of the locking bar in alternative directions, a spring 156 biasing locking bar 153 and hooks 152, 152' and elastically supporting hook 152 so as to rotate locking bar 153 in one direction for maintaining the closed state that hook 152 hooks locker 151, and a handle 157 formed on a center portion of locking bar 153. Piercing holes 158 and 158' are formed on door frame 100. Hooks 152 and 152' pass through piercing holes 158, 158' and are hooked by hook locker 151. A handle hole 159 is formed on door frame 100 and provides a space allowing handle 157 to move and rotate about locking bar 153.

In the printing machine, two pressure units are placed on both sides of the developing unit and the sensitive belt unit installed in the main body. Each pressure unit is disposed on each side of the developing unit and the sensitive belt unit to support the developing unit rotating the sensitive belt of the sensitive belt unit. One of the two pressure units is disposed on a sidewall of the main body where door frame 100 is mounted on the main body. When repair and replacement of any one of the developing unit, the sensitive belt unit, and any other components installed in the main body, the repair and the replacement can be done after door frame 100 is opened and the pressure unit is detached from the developing unit and the sensitive belt unit. Pressure-unit fixing bracket 200 is supposed to accommodate the insertion of parts of the developing unit, the sensitive belt unit, and the components installed in the main body and support the pressure unit attached to the developing unit, the sensitive belt unit to the main body when door frame 100 is closed.

Pressure-unit fixing bracket 200 supports the pressure unit of the main body and includes a fixing hole 210 guiding and fixing the pressure unit into pressure-unit fixing bracket 200 and a shaft supporting hole 220 receiving and supporting the pressure unit and the shafts of the various components installed in the main body of the printing machine. Pressure-unit fixing bracket 200 is installed inside the door frame 100 to be moved in a required direction allowing each one end of parts or shafts of the pressure unit, the developing unit the sensitive belt unit, and the components to be inserted into the holes 210, 200 by inserting a buffer unit 300 between door frame 100 and pressure-unit fixing bracket 200.

Buffer unit 300 includes at least four guiding holes 310 formed on door frame 100, guide protrusions 320 corresponding to the four guiding holes 310 and formed on pressure-unit fixing bracket 200, anti-bolt pins 330 preventing guiding protrusions 320 of pressure-unit fixing bracket 200 from being detached from door frame 100 by being engaged with the ends of guiding protrusions 320 protruding through guiding holes 310, and compressing coil springs 340 engaged with each of the guiding protrusions 320 and elastically supporting pressure-unit fixing bracket 200 in a manner that pressure-unit fixing bracket 200 is spaced-apart from door frame 100 by a certain distance and movably attached to door frame.

Pressure-unit fixing bracket 200 moves toward the pressure unit supported by pressure-unit fixing bracket 200 in a manner that the shafts of the various components in the body of the printing machine is supported by pressure-unit fixing bracket 200 during the opening and closing of the door without intervening between pressure-unit fixing bracket 200 and the shafts. Therefore, the shafts of the components can be inserted into the corresponding holes without bending and distorting of the shaft.

A pair of determining holes 250 and 260 are formed on both sides of pressure-unit fixing bracket 200. A pair of guiding pins 230 and 240 attached to the main body of the printing machine is disposed to be inserted into determining holes 250 and 260 so as to guiding pressure-unit fixing bracket 200 and allowing the shafts to be precisely inserted into the holes formed on pressure-unit fixing bracket 200 during opening and closing of the door. Thus, pressure-unit fixing bracket 200 can be placed at an exact position to support the pressure unit when the door is closed. One position determining hole 260 is larger than the other position determining holes 250, and one pin 240 is longer than the other pin 230 in consideration of the movement and rotation of pressure-unit fixing bracket 200 about a center of the hinge unit.

Door frame 100 rotates to be opened and closed by inserting and assembling hinge protrusions 111 and 121 of door-side hinge brackets 110 and 120 into hinge holes 131 and 141 of body-side hinge brackets 130 and 140. When the door is closed, hooks 152 and 152' of locking and unlocking unit 150 are hooked by locker 151 of the main body of the printing machine and then can not be opened accidentally.

When handle 157 is pulled forward during the closed state, the locking state between hooks 152. 152' and lockers 151, 151' is released, and then the door starts to be opened. Pressure-unit fixing bracket 200 movably installed inside the door is moved in the desired direction releasing the shafts and components of the main body from the holes, and then pressure-unit fixing bracket 200 I and the shafts engaged with each hole of pressure-unit fixing bracket 200 supporting the pressure unit are smoothly disengaged from each other without the interference between the holes and the shafts. That is, the door be opened by the rotational movement without sliding movement in a direction parallel to the shaft and perpendicular to the sidewall of the main body.

When the door is closed, as described above, pressure-unit fixing bracket 200 is moved in the desired direction, and then the shafts of the various components of the printing machine are engaged with shaft supporting holes 220 of pressure-unit fixing bracket 200 and the press unit hole. Accordingly, pressure-unit fixing bracket 200 is aligned at an exact position where guiding pins 230 and 240 of the printing machine are inserted into position determining holes 250 and 260 formed on both sides of pressure-unit fixing bracket 200 and the shafts are inserted into shaft supporting holes 220 and fixing holes 210 formed on pressure-unit fixing bracket 200.

According to the present invention as described above, the pressure-unit fixing bracket is movably mounted on the door frame, and the buffer unit is disposed between the pressure-unit fixing bracket and the door frame to adjust the position of the pressure-unit fixing bracket so as to insert shafts and components of the main body of the printing machine into holes formed on the pressures unit fixing bracket and absorb the interference occurring between the pressure unit and the components or the pressure unit and the pressure-unit fixing bracket within the printing machine when the door is opened and closed. Therefore, the door rotates to be opened and closed by using the simple hinge unit. The pressure unit and the various components of the printing machine can be attached to or detached from the pressure-unit fixing bracket located in exact relative positions under uniform force. Thus, the more convenient process and the less cost of manufacturing of the door having the pressure-unit fixing unit are accomplished.

Although the preferred embodiment of the present invention has been shown and described, it will be appreciated by those skilled in the art that changes may be made in these embodiments without departing from the principles and spirit of the invention, the scope of which is defined in the claims and their equivalents.

What is claimed is:

1. A door apparatus in a printer, comprising:

a door rotatably mounted on a main body of said printer, covering a side of said main body when said door is closed;

a bracket movably attached to an inner side of said door, having a supporting hole receiving an end portion of a component installed in said main body, said end portion of said component disposed adjacent to said side to be inserted into said supporting hole of said bracket when said door is closed; and a buffer unit disposed between said door and said bracket to elastically support said bracket.

2. The door apparatus of claim 1, further comprising:

a first positioning hole formed on said bracket; and a first guide pin attached to said side of said main body, inserted into said positioning hole before said supporting hole receives said end portion of said component when said door is closed, guiding said bracket to allow said supporting hole to receive said end of said component.

3. The door apparatus of claim 2, further comprising:

a second positioning hole receiving a second guide pin and being smaller than said first positioning hole receiving said first guide pin; and a second guide pin inserted into said second positioning hole, being longer than said first guide pin inserted into said first positioning hole.

4. The door apparatus of claim 1, said bracket comprising a plurality of fixing holes formed on said bracket and receiving and supporting each corresponding end of components, said each corresponding end disposed adjacent to said side of said main body to contact one of said fixing holes when said door is closed.

5. The door apparatus of claim 1, said buffer unit comprising:

a protrusion protruding from said bracket, slidably connected to said door; and a resilient element disposed between said door and said bracket to elastically connect said bracket to said door and move said bracket against said door.

6. The door apparatus of claim 1, said buffer unit comprising:

at least one guiding hole formed on said door;

at least one protrusion protruding from said bracket, slidably inserted into said guiding hole, movably coupled to said door; and a resilient element disposed between said door and said bracket to elastically connect said bracket to said door and move said bracket against said door.

7. The door apparatus of claim 6, said buffer unit comprising a pin coupled to said one end of said protrusion while said one end of said protrusion is inserted into said hole and protruded from said door.

8. The door apparatus of claim 1, further comprising a hinge unit including a door bracket fixed to said door, a body bracket fixed to said body, and a connector rotatably connecting said door bracket to said body bracket.

9. The door apparatus of claim 1, further comprising:

a body-side hinge bracket attached to said side of said main body, having a hinge hole; and a door-side hinge bracket attached to said door, having a hinge protrusion inserted into said hinge hole of said body-side hinge bracket.

10. The door apparatus of claim 1, further comprising a hinge unit including a door bracket fixed to said door a body bracket fixed to said body, a first connector rotatably connecting said door bracket to said body bracket, and a second connector connected said first connector and said door bracket and moving said door perpendicular to said side of said main body.

11. The door apparatus of claim 1, further comprising a locking unit including:

a locking bar rotatably mounted on said door; and a hooking element coupled to said locking bar, coupled to a locker formed on said main body.

12. The door apparatus of claim 1, said locking unit comprising a bias spring coupled to said door and said locking bar, biasing said hooking element to be hooked by said locker.

13. The door apparatus of claim 1, said locking unit comprising a handle mounted on said locking bar and disposed on a cutoff portion formed on said door to rotate with said locking bar.

14. A door apparatus in a printer, comprising:

a door installed at a surface of a printer to be rotatably opened and closed;

a bracket movably attached to an inner surface of said door, having holes receiving shafts of components installed in said printer when said door is closed; and a buffer disposed between said bracket and said door to move said bracket against said door while said shafts are inserted into and released from said holes when said door is closed and opened.

15. The door apparatus of claim 14, said buffer comprising:

at least one guiding hole formed on said door;

a protrusion formed on said bracket and protruding from said bracket to correspond to said guiding hole, a pin coupled to one end of said protrusion while said protrusion is inserted into said guiding hole, preventing said guiding protrusion and said bracket from being detached from said door; and a spring disposed between said door and said bracket to elastically support said bracket spaced-apart from said door by a predetermined distance.

16. The door apparatus of claim 14, further comprising a door-side hinge bracket attached to one side of said door, having a hinge protrusion inserted into a hinge hole formed on a body-side hinge brackets attached to said printer.

17. The door apparatus of claim 14, further comprising a locking and unlocking unit mounted on the other side of said door and locking and unlocking said door.

18. The door apparatus of claim 17, said locking and unlocking unit comprising:

a locking bar rotatably mounted on said door, having a hooking element hooked by a locker a mounted on said printer; and a spring coupled between said locking bar and said door, elastically supporting said hook to rotate said locking bar and said hooking element in one direction thereby maintaining said hooking element to be hooked by said locker.

19. The door apparatus of claim 17, said locking and unlocking unit comprising:

a handle formed on said locking bar; and a fixing element fixed to said door, rotatably supporting said locking bar.

20. The door apparatus of claim 14, further comprising:

a first position determining hole formed on said bracket and receiving a first guide pin mounted on said printer when said door is closed; and a second position determining hole formed on said bracket and receiving a second guide pin, being larger than said first position determining hole formed on said bracket and receiving said first guide pin.

* * * * *